US005559327A

United States Patent [19]

Steiner

[11] Patent Number: 5,559,327

[45] Date of Patent: Sep. 24, 1996

[54] ION FILTER AND MASS SPECTROMETER USING ARCUATE HYPERBOLIC QUADRAPOLES

[75] Inventor: Urs Steiner, Sunnyvale, Calif.

[73] Assignee: Bear Instruments, Inc., Santa Clara, Calif.

[21] Appl. No.: 508,029

[22] Filed: Jul. 27, 1995

[51] Int. Cl.[6] ..... H01J 49/42

[52] U.S. Cl. ..... 250/292; 250/291; 250/294; 250/296

[58] Field of Search ..... 250/292, 291, 250/290, 294, 296, 281, 396 R; 313/251, 361.1

[56] References Cited

U.S. PATENT DOCUMENTS

| | | | |
|---|---|---|---|
| 2,520,813 | 8/1950 | Rudenberg | 250/396 R |
| 3,715,581 | 2/1973 | Matsuda | 250/290 |
| 3,757,115 | 9/1973 | Ball | 250/294 |
| 4,158,771 | 6/1979 | Beeck et al. | 250/294 |
| 4,885,470 | 12/1989 | Abbott | 250/396 R |
| 4,885,500 | 12/1989 | Hansen et al. | 313/256 |
| 4,949,047 | 8/1990 | Hayward et al. | 328/233 |
| 5,298,745 | 3/1994 | Kernan et al. | 250/292 |
| 5,373,157 | 12/1994 | Hiroki et al. | 250/292 |
| 5,389,785 | 2/1995 | Steiner et al. | 250/292 |
| 5,420,425 | 5/1995 | Bier et al. | 250/292 |

*Primary Examiner*—Jack I. Berman
*Assistant Examiner*—Kiet T. Nguyen
*Attorney, Agent, or Firm*—Townsend and Townsend and Crew; Henry K. Woodward

[57] ABSTRACT

A generally circular mass spectrometer and ion filters used therein have hyperbolic pole pieces which can be machined by diamond turning. In a quadrature assembly, two pole segments can be identical and provide the outer arcuate pole surfaces, and two segments can be identical and provide the inner arcuate pole surfaces opposite from the outer pole surfaces. A support plate has an arcuate outer surface which engages alignment surfaces of the pole segments, the alignment surfaces and outer support surfaces being machined by turning. In a quadrapole, one outer pole piece and one inner pole piece are mounted on each support surface of the plate with the alignment surfaces in abutment with the support plate outer surface for accurate alignment. An outer pole segment on one support surface is electrically connected to an inner pole segment on the opposing support surface. Each support segment has a plurality of spokes for mounting to the support plate. The spokes for an outer pole segment and an inner pole segment mounted on one surface of the support plate are interleaved. A single mounting bolt through each support spoke engages a machined hole in the support plate and holds an upper pole segment to its opposing lower pole segment.

25 Claims, 9 Drawing Sheets

ION FILTER AND MASS SPECTROMETER USING ARCUATE HYPERBOLIC QUADRAPOLES

BACKGROUND OF THE INVENTION

This invention relates generally to ion filters such as used in mass spectrometers and mass analyzers, and more particularly the invention relates to arcuate (including circular segments) hyperbolic quadrapoles.

Mass spectrometers are well known scientific instruments for analyzing chemical structures. A mass spectrometer includes an ion source, an ion filter, and an ion detector. Gas at low pressure is introduced into the ion source which ionizes the gas. Ions are then selected by the ion filter and passed to the ion detector. The ion filter selects ions having a particular m/e ratio which may be varied to analyze the gas. Examples of mass spectrometers are described in U.S. Pat. Nos. 5,389,785; 5,298,745; 4,949,047; 4,885,470; 4,158,771; and 3,757,115.

These and other known mass spectrometers employ filters having linear hyperbolic quadrapoles. FIG. 1 is a schematic perspective view of the ion filter described in U.S. Pat. No. 5,389,785 to Urs Steiner et al. The filter includes four linear rod electrodes 3, each rod electrode having a hyperbolic curved pole surface 5 and two abutment surfaces 7 so that the rods can be assembled with opposing pairs of hyperbolic surfaces. Rods with opposing hyperbolic surfaces are electrically connected, and both RF and DC voltages are impressed on the rods with the RF voltages on adjacent poles being out of phase and the DC voltages on adjacent poles being offset.

The hyperbolic surfaces must be very smooth and accurately machined. Due to the linear configuration of the pole segments, a grinding tool is used in machining the surfaces. This necessarily limits the accuracy in machining the surfaces.

SUMMARY OF THE INVENTION

The present invention provides an ion filter having multiple poles which can be more readily and accurately machined. The pole segments can be mounted on an optical flat support plate for alignment.

In a preferred embodiment, the pole segments have generally circular arcuate surfaces which can be accurately machined by turning. This is more accurate than linear milling or grinding and allows machining of different materials. In a quadrapole assembly, two segments can be identical and provide the outer arcuate pole surfaces, and two segments can be identical and provide the inner arcuate pole surfaces opposite from the outer pole surfaces. Multiple segments can be machined in one operation thus reducing manufacturing costs. Further, the simultaneous turning of the segments helps to insure that hyperbolic and alignment surfaces of the segments are concentric.

In the preferred embodiment, the support plate has an outer surface accurately machined by turning and opposing parallel support surfaces. In a four pole (quadrupole), one outer pole segment and one inner pole segment are mounted on each support surface of the plate with alignment surfaces in abutment with the outer surface for accurate alignment. An outer pole segment on one support surface is electrically connected with an inner pole segment on the opposing support surface. Each pole segment has support spokes with support spokes being interleaved with the outer pole segments and the inner pole segments on each support plate surface. A single mounting bolt through each support spoke engages a machined hole in the support plate and holds an upper pole segment to its opposing lower pole segment.

A multiple stage quadrupole (MS/MS) instrument including a first filter, a collider, and a second filter can be serially aligned with a prefilter on support plates between an ion source and an ion detector. Each component of the MS/MS comprises a multipole segment having an arc between 10° and 90°. The support plate accurately aligns the entire ion path by aligning the multiple segments with each other.

The invention and objects and features thereof will be more readily apparent from the following detailed description and appended claims when taken with the drawing.

DETAILED DESCRIPTION OF ILLUSTRATIVE EMBODIMENTS

Figure 1:
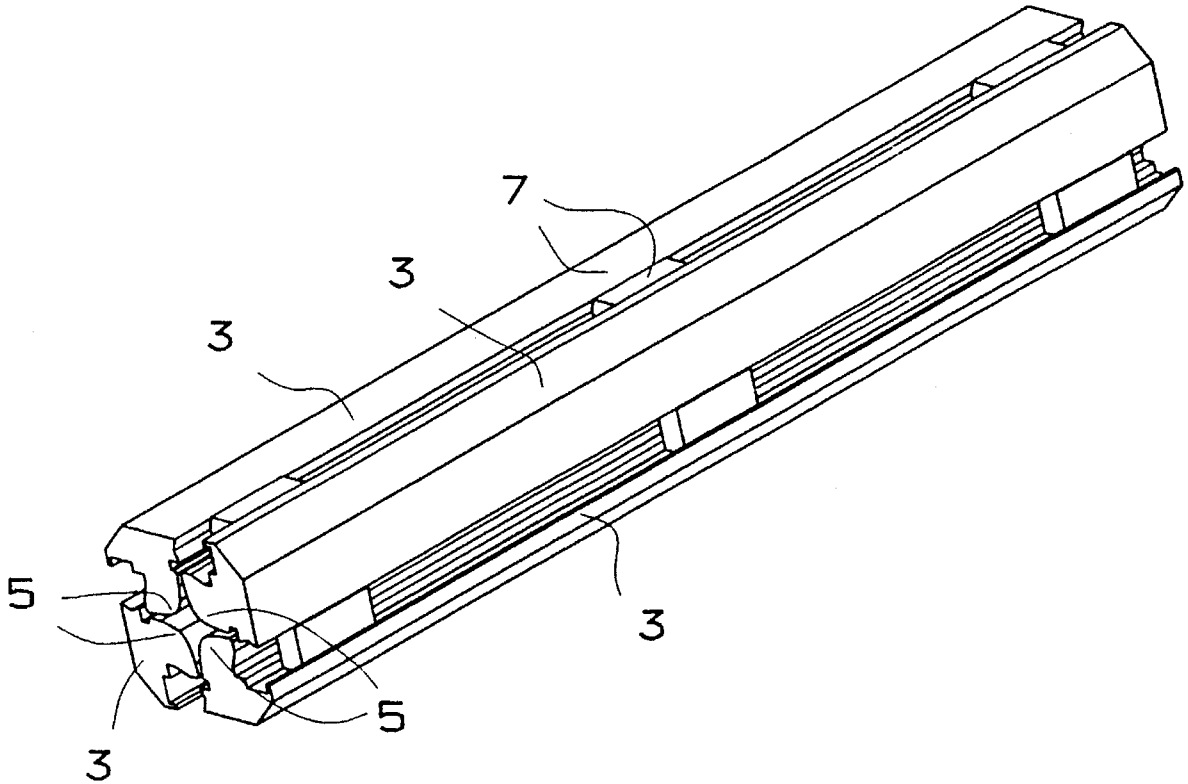
FIG. 1 PRIOR ART
FIG. 1 is a perspective view of an ion filter in accordance with the prior art.
Figure 2:
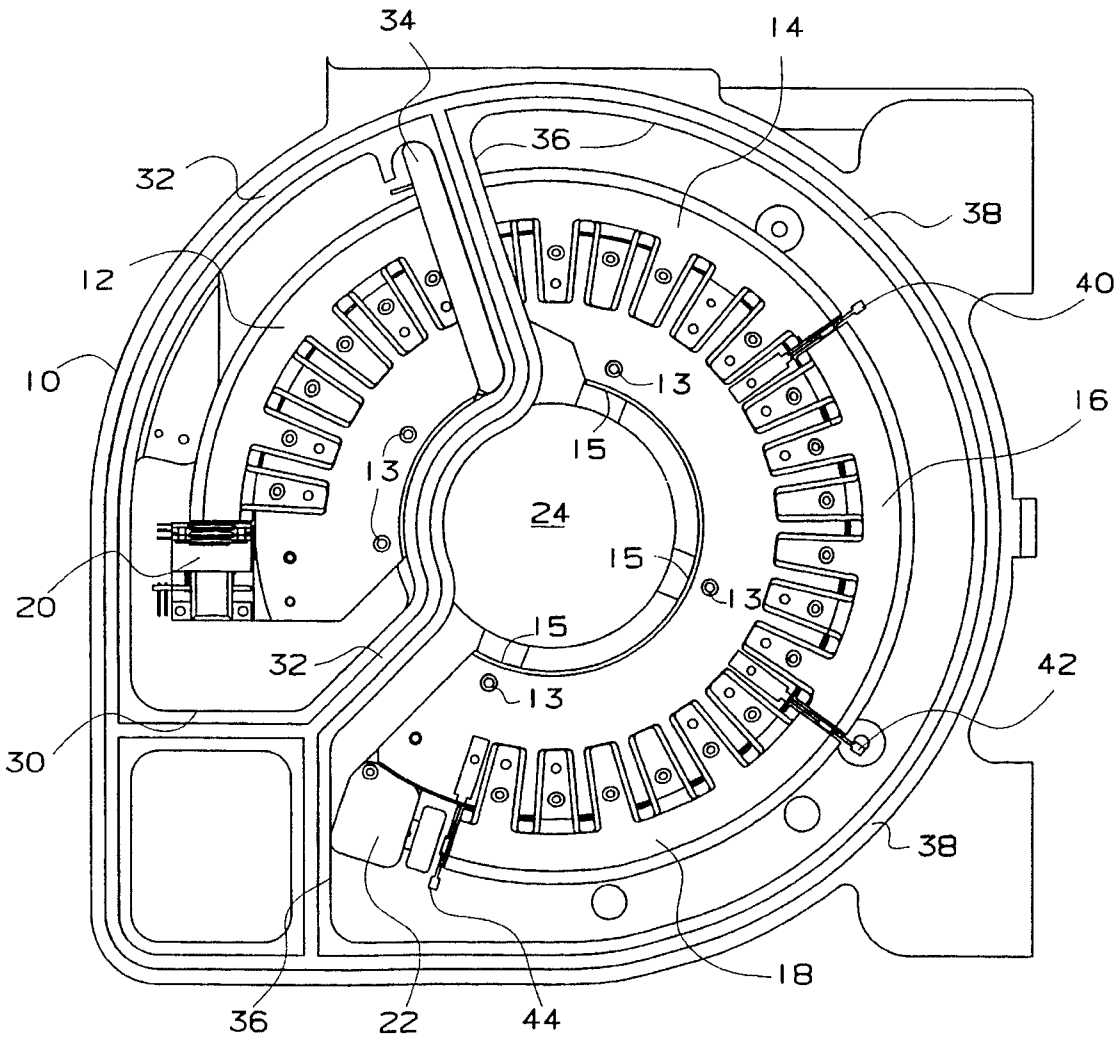
FIG. 2 is a plan view of mass spectrometer using ion filters in accordance with an embodiment of the invention.

Referring now to the drawing, FIG. 2 is a plan view of a mass spectrometer employing hyperbolic quadrapoles in accordance with the invention. The mass spectrometer is mounted in a housing 10 with a prefilter 12, a primary mass filter 14, a collision cell 16, and a secondary mass filter 18 in serial alignment between an ion source 20 and an ion detection system 22. Posts 15 are provided for mounting quadrapole segments. Ion source 20 and ion detection system 22 are conventional elements known in the prior art. An ultra high vacuum pump 24 is centrally disposed in the housing to maintain a vacuum in the quadrapole elements. Prefilter 12 is positioned in a first sealed region of the housing provided by the wall 30 and 0-ring 32 which engages a cover (not shown) to provide the vacuum seal for a source pressure vacuum chamber. An ion lens 34 permits ions to pass from prefilter 12 to the primary mass filter 14 in a second sealed chamber of the housing provided by wall 36 and an o-ring 38 which mates with the cover (not shown) whereby a pressure on the order of $10^{-6}$ Torr can be maintained for an analyzer pressure vacuum chamber. Ion lens 40 is provided between the primary mass filter 14 and the collision cell 16, ion lens 42 is provided between collision cell 16 and secondary mass filter 18, and ion lens 44 is provided between secondary mass filter 18 and detector 22.

Figure 3:
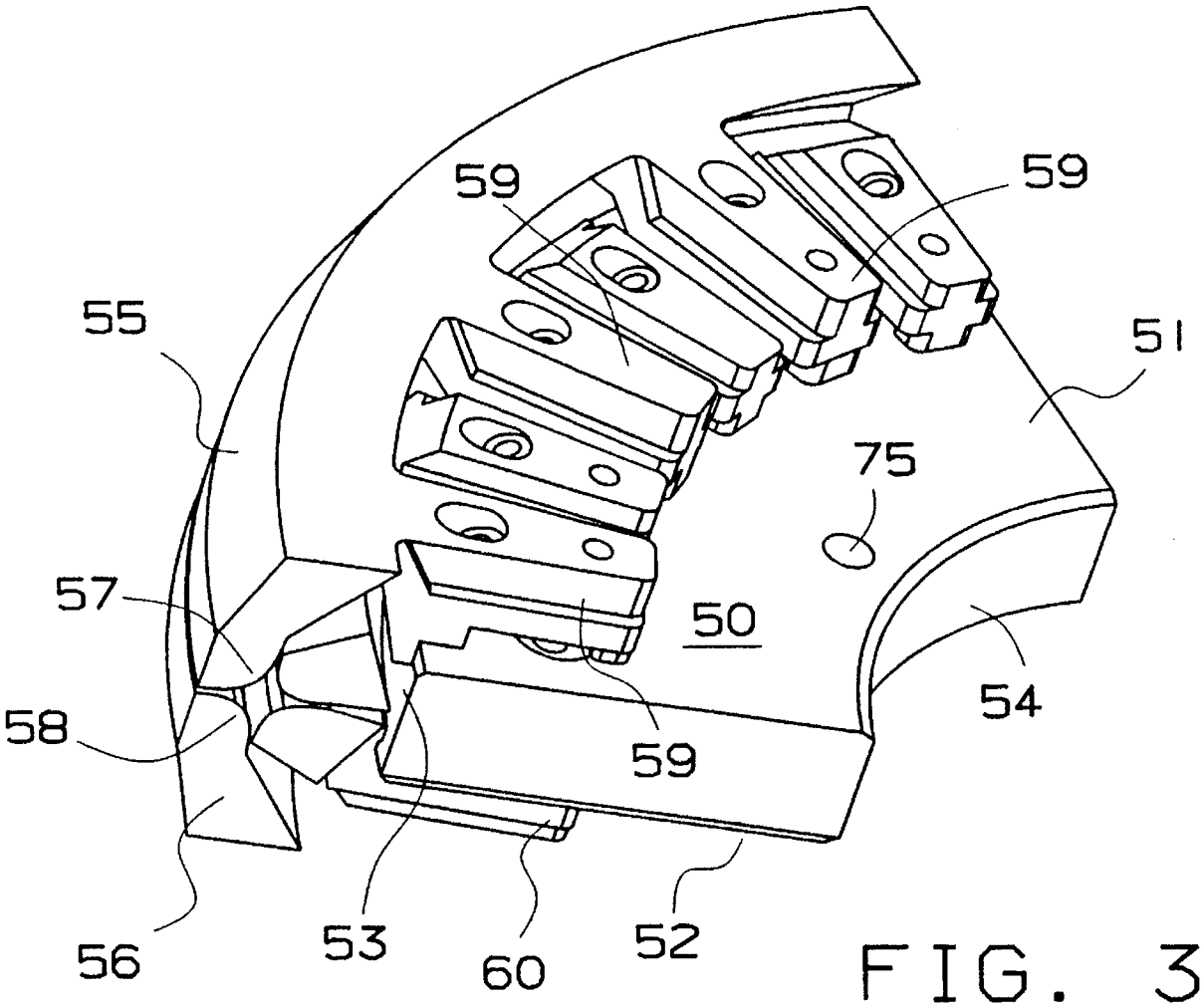
FIG. 3 is a perspective view of a quadrapole segment illustrating the four pole pieces mounted on a support plate.
Figure 4:
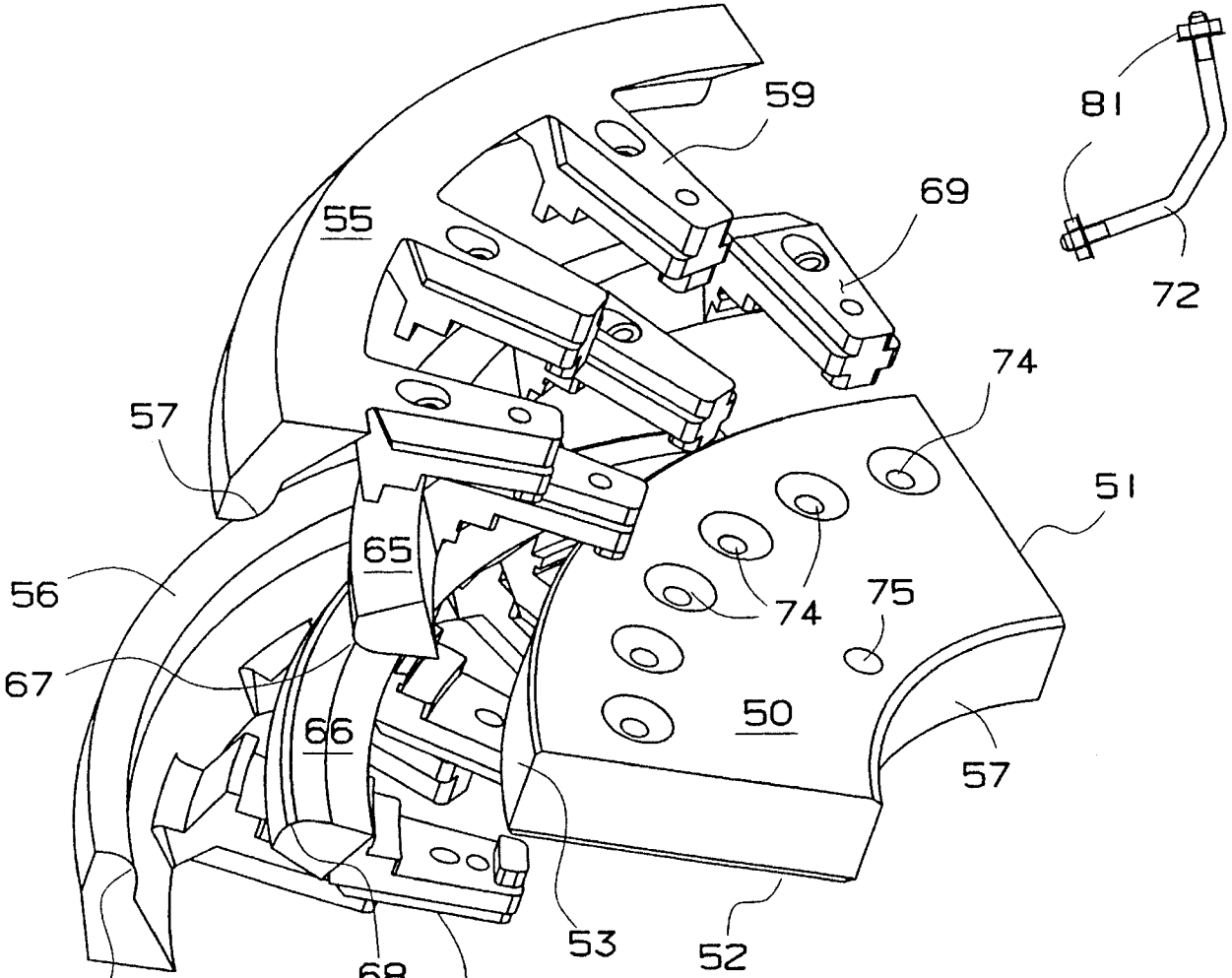
FIG. 4 is an exploded perspective view of the quadrapole segment of FIG. 3.

In the preferred embodiment of FIG. 2, prefilter 12, primary mass filter 14, collision cell 16, and secondary mass filter 18 have quadrupole pieces which define a generally circular path between ion source 20 and ion detection system 22. FIG. 3 and FIG. 4 are perspective views of a quadrupole filter assembly of the embodiment in FIG. 2 as assembled and in an exploded view, respectively, and FIGS. 5–7 further illustrate component parts of the assemblies. As shown in FIG. 3, the filter includes a support plate 50 having opposing parallel support surfaces 51, 52 an outer arcuate surface 53, and an inner surface 54. In preferred embodiments the arcuate surfaces are segments of a circle. First and second arcuate outer pole segments 55, 56 having arcuate hyperbolic pole surfaces 57, 58 along first sides and a plurality of support spokes 59, 60 on an opposing side are mounted on opposing parallel support surfaces of support plate 50 as shown in FIG. 4. First and second arcuate inner pole segments 65, 66 having arcuate hyperbolic pole surfaces 67, 68 along first sides, and a plurality of support spokes 69, 70 on opposing sides are mounted on opposing support surfaces of the support plate 50. Outer pole segment 55 and inner pole segment 65 are mounted on support surface 51, and outer pole segment 56 and inner pole segment 66 are mounted on the opposing support surface 52 with the spokes of an outer pole segment interleaving with the spokes of the inner pole segment on each support surface. A single mounting bolt 72 through each support spoke and a hole 74 in the support plate 50 holds an outer pole segment to its opposing inner pole segment with the hyperbolic surfaces of the pole segments opposing each other. The mounting bolts also make electrical connection between the two opposing poles. Mounting bolt 72 and nuts 81 with spring washers load the segments to the support plate.

The assembled ion filter is mounted in housing 10 of FIG. 2 with bolts 13 fastening alignment posts 15 to the holes 75 in the support plate 50.

Figure 5A:
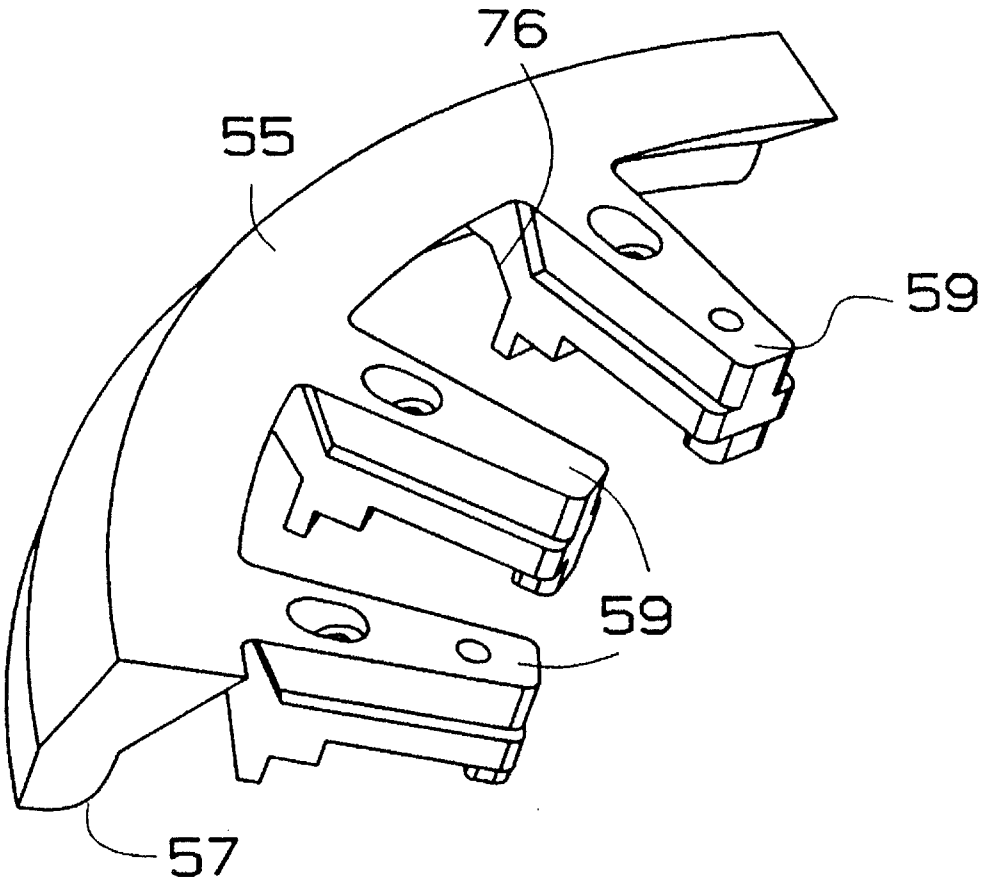
FIGS. 5A and 5B are perspective views of the outer pole piece and the inner pole piece mounted on the top surface of the support plate in FIGS. 3 and 4.
Figure 5B:
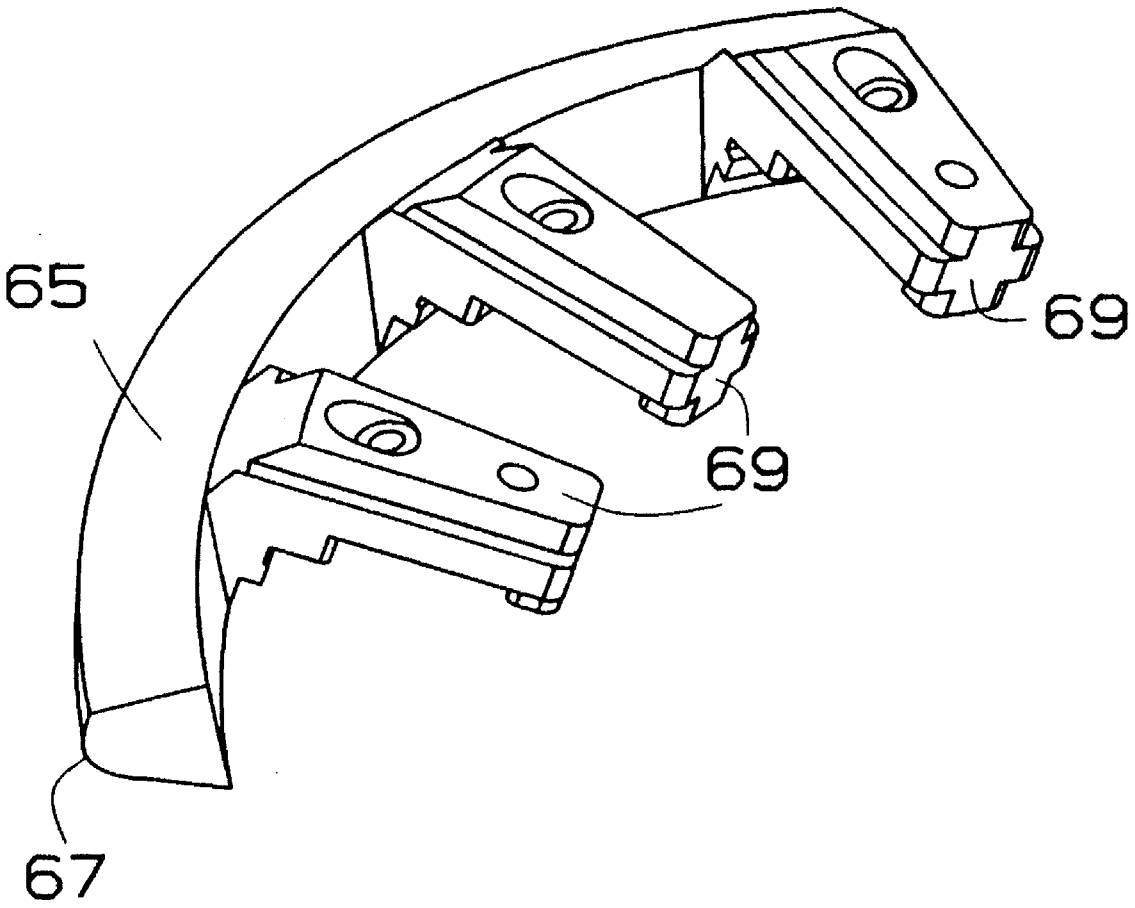

FIGS. 5A and 5B are perspective views of outer pole segment 55 and inner pole segment 65 which are mounted on support surface 51 of support plate 50. The support spokes 59 and 69 are offset for interleaving on the support plate, and outer pole segment 55 is raised as shown at 76 to accommodate the inner pole segment 65 without physical contact therebetween.

Figure 6A:
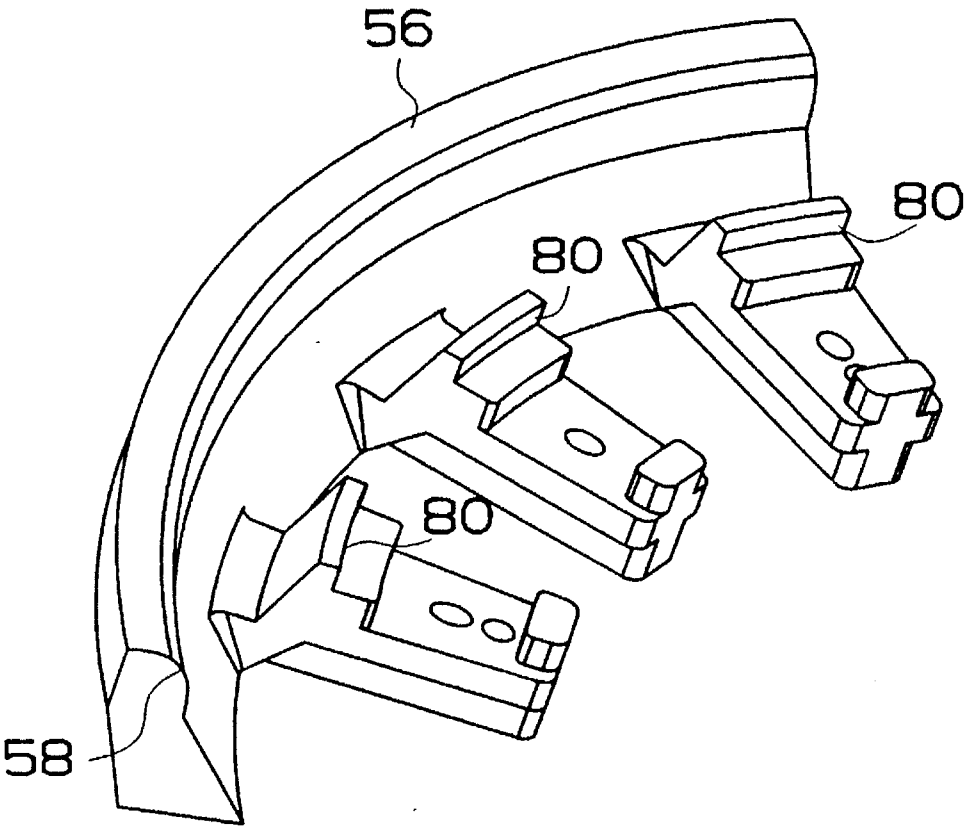
FIGS. 6A and 6B are perspective views of the outer pole piece and the inner pole piece mounted on the bottom surface of the support plate of FIGS. 3 and 4.
Figure 6B:
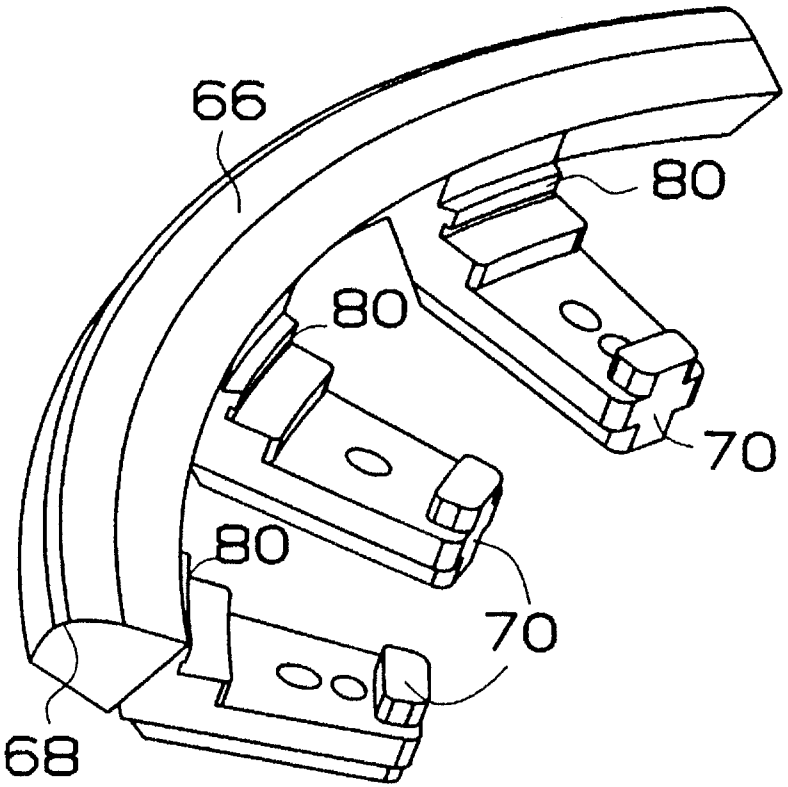

FIGS. 6A and 6B are perspective views of outer pole segment 56 and inner pole segment 66 which are mounted on support surface 52 of support plate 50. The outer pole segment 56 and inner pole segment 66 are identical to the outer pole segment 55 and inner pole segment 65 and illustrate the bottom surfaces of pole segments 55, 65. Each of the pole segments has arcuate alignment surfaces 80 which are accurately machined for abutting the outer arcuate surface 53 of support plate 50.

Figure 7:
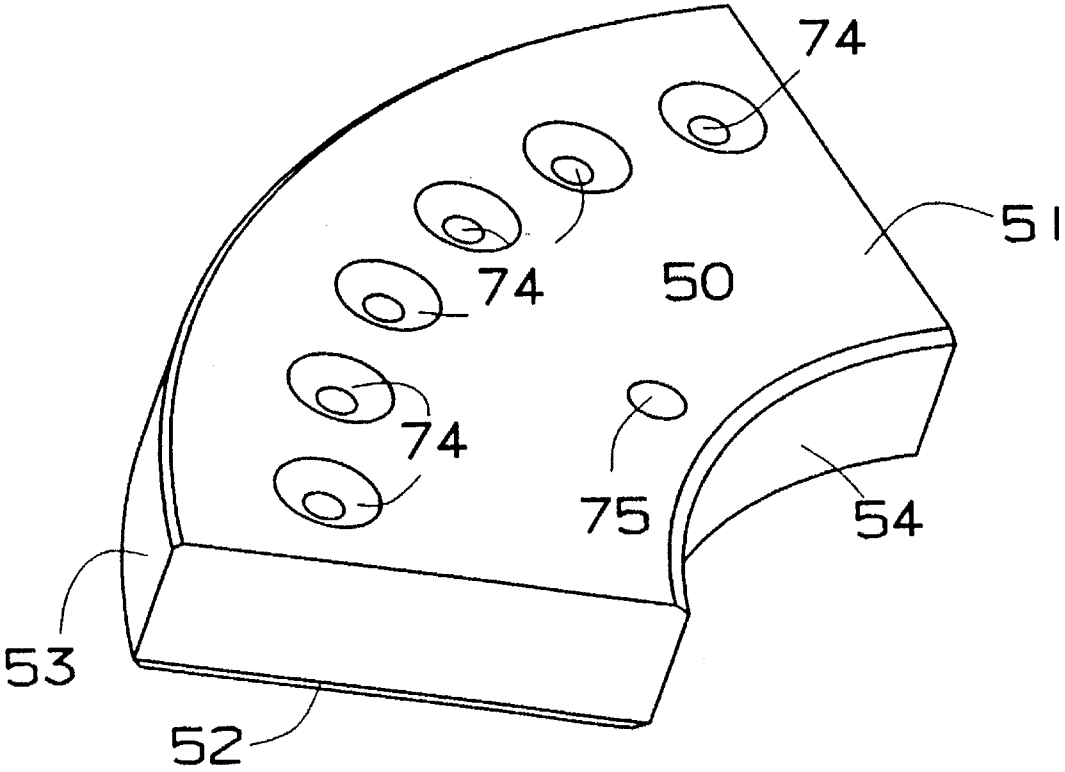
FIG. 7 is a perspective view of the support plate in FIGS. 3 and 4.

FIG. 7 is a perspective view of support plate 50 further illustrating the outer arcuate surface 53, the inner surface 54, top support surface 51 and bottom support surface 52 with the holes 74, 75 provided through the support plate for mounting of pole segments and for mounting the support plate in housing 10 of FIG. 2. The support plate is electrically insulative and is machined for optical flatness and subtends an angle between 10° and 90°. Advantageously, the outer arcuate surfaces can be accurately machined by turning as are the arcuate surfaces of the pole segments. Preferably, the support plate is made of a hard material such as quartz, glass, ceramic, or granite.

In a preferred embodiment, each of the pole segments is made of a composite silicon carbide loaded aluminum alloy (LANXIDE™ reinforced aluminum) which provides stiffness, low coefficient of thermal expansion, very high thermal conductivity, and lightweight. The arcuate surfaces along with the hyperbolic surfaces are readily machined by diamond or carbide turning, for example, to provide accuracy and smoothness of the surfaces. The roundness along the ion path between the hyperbolic surfaces provides accurate concentricity of the hyperbolic surfaces. Advantageously, multiple segments can be machined in one operation which reduces manufacturing costs. In a preferred embodiment, after machining the hyperbolic surfaces of the aluminum alloy pole segments, the hyperbolic surfaces are metal plated with nickel, gold, or other suitable metal and then again diamond or carbide turned. The diamond turning of nickel avoids potential irregularities of diamond turning of an aluminum alloy including elements of carbon.

There has been described an ion filter and a mass spectrometer which are generally circular in structure using identical arcuate inner pole piece segments and outer pole piece segments and the method of fabrication using machine turning. While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. An ion filter comprising:

a support plate having opposing parallel support surfaces, first and second arcuate outer pole segments each having an arcuate hyperbolic pole surface along one side and a plurality of support spokes extending from an opposing side, first and second arcuate inner pole segments each having an arcuate hyperbolic pole surface along said one side and a plurality of support spokes extending from said opposing side, means for fastening one arcuate outer pole segment and one arcuate inner pole segment on each support surface, said one arcuate outer pole segment and said one arcuate inner pole segment having opposing hyperbolic surfaces, and means for electrically connecting said opposing hyperbolic surfaces.

2. The ion filter as defined by claim 1 wherein said support plate has an outer arcuate surface and each pole segment includes an arcuate alignment surface which abuts said outer arcuate surface of said support plate.

3. The ion filter as defined by claim 2 wherein said arcuate hyperbolic pole surfaces are segments of a circle.

4. The ion filter as defined by claim 3 wherein said support spokes of said outer pole segment and said inner pole segment fastened on one support surface are interleaved.

5. The ion filter as defined by claim 4 wherein said means for fastening comprises a plurality of bolts with each bolt engaging a support spoke of said outer pole segment on one support surface and a support spoke of said inner pole segment on an opposing support surface.

6. The ion filter as defined by claim 5 wherein said plurality of bolts provide said means for electrically connecting said opposing hyperbolic surfaces through said segments.

7. The ion filter as defined by claim 6 wherein said support plate is electrically non-conductive and said pole segments are electrically conductive.

8. The ion filter as defined by claim 7 wherein said support plate comprises material selected from the group consisting of quartz, glass, ceramic, and granite.

9. The ion filter as defined by claim 8 wherein said pole segments comprise an aluminum alloy.

10. The ion filter as defined by claim 9 wherein said aluminum alloy is silicon carbide filled aluminum.

11. The ion filter as defined by claim 10 wherein said hyperbolic surfaces of said pole segments are metal plated.

12. The ion filter as defined by claim 11 wherein said hyperbolic surfaces are machined by diamond turning.

13. A mass analyzer comprising:

a housing, an ion source in said housing, an ion detector in said housing, a plurality of ion filters serially arranged between said ion source and said ion detector, each ion filter including:

a support plate having opposing parallel support surfaces, first and second arcuate outer pole segments each having an arcuate hyperbolic pole surface along one side and a plurality of support spokes extending from an opposing side, first and second arcuate inner pole segments each having an arcuate hyperbolic pole surface along side one side and a plurality of support spokes extending from said opposing side, means for fastening one arcuate outer pole segment and one arcuate inner pole segment on each support surface, said one arcuate outer pole segment and said one arcuate inner pole segment having opposing hyperbolic surfaces, and means for electrically connecting said opposing hyperbolic surfaces, and means for providing a source pressure vacuum chamber and an analyzer pressure vacuum chamber.

14. The mass analyzer as defined by claim 13 wherein said means for providing said source pressure vacuum chamber and said analyzer pressure vacuum chamber includes a cover engaging said housing with a seal therebetween.

15. The mass analyzer as defined by claim 14 wherein said support plate has an outer accurate surface and each pole segment includes an arcuate alignment surface which abuts said outer arcuate surface of said support plate.

16. The mass analyzer as defined by claim 15 wherein said arcuate hyperbolic pole surfaces are segments of a circle.

17. The mass analyzer as defined by claim 16 wherein said support spokes of said outer pole segment and said inner pole segment fastened on one support surface are interleaved.

18. The mass analyzer as defined by claim 17 wherein said means for fastening comprises a plurality of bolts with each bolt engaging a support spoke of said outer pole segment on one support surface and a support spoke of said inner pole segment on an opposing support surface.

19. The mass analyzer as defined by claim 18 wherein said plurality of bolts provide said means for electrically connecting said opposing hyperbolic surfaces through said segments.

20. The mass analyzer as defined by claim 19 wherein said support plate is electrically non-conductive and said pole segments are electrically conductive.

21. The mass analyzer as defined by claim 20 wherein said support plate comprises material selected from the group consisting of quartz, glass, ceramic, and granite.

22. The mass analyzer as defined by claim 21 wherein said pole segments comprise an aluminum alloy.

23. The mass analyzer as defined by claim 22 wherein said aluminum alloy is silicon carbide filled aluminum.

24. The mass analyzer as defined by claim 23 wherein said hyperbolic surfaces of said pole segments are nickel plated.

25. The mass analyzer as defined by claim 24 wherein said hyperbolic surfaces are machined by diamond turning.

* * * * *